US006609490B2

(12) United States Patent
Flinchbaugh et al.

(10) Patent No.: US 6,609,490 B2
(45) Date of Patent: Aug. 26, 2003

(54) PISTON HEAD FOR A SPARK IGNITION ENGINE

(76) Inventors: John Flinchbaugh, 4301 California Ave., #33, Bakersfield, CA (US) 93309; Michael Lee Anderson, deceased, late of Bakersfield, CA (US); by Marsha B. Anderson, legal representative, P.O. Box 78703, Bakersfield, CA (US) 93383-8703

( * ) Notice: Subject to any disclaimer, the term of this patent is extended or adjusted under 35 U.S.C. 154(b) by 0 days.

(21) Appl. No.: 10/001,096

(22) Filed: Nov. 15, 2001

(65) Prior Publication Data

US 2003/0089329 A1 May 15, 2003

(51) Int. Cl.[7] ..... F02F 3/24
(52) U.S. Cl. ..... 123/193.6; 123/657
(58) Field of Search ..... 123/193.6, 657

(56) References Cited

U.S. PATENT DOCUMENTS

| | | | | |
|---|---|---|---|---|
| 2,882,106 | A | 4/1959 | Meurer | 309/9 |
| 3,057,334 | A | 10/1962 | Bailey | 123/32 |
| 3,189,010 | A | 6/1965 | Isley | 123/41.35 |
| 3,814,068 | A | 6/1974 | Kimbara | 123/32 A |
| 4,617,888 | A | 10/1986 | Dent | 123/307 |
| 4,676,210 | A | 6/1987 | Moser | 123/301 |
| 4,711,208 | A | 12/1987 | Sander | 123/271 |
| 4,712,526 | A | 12/1987 | Caughran | 123/307 |
| 4,719,884 | A | 1/1988 | Shinno | 123/269 |
| 4,858,566 | A | 8/1989 | Paul | 123/41.35 |
| 4,942,804 | A | 7/1990 | Matsuura | 92/212 |
| 5,042,441 | A | 8/1991 | Paul | 123/276 |
| 5,063,894 | A | 11/1991 | Mielke | 123/193 |
| 5,146,883 | A | 9/1992 | Reipert | 123/193.6 |
| 5,447,130 | A | 9/1995 | Kawamura | 123/269 |
| 5,934,174 | A | 8/1999 | Abraham | 92/222 |
| 6,170,454 | B1 | 1/2001 | McFarland et al. | 123/193.6 |

*Primary Examiner*—Noah P. Kamen
(74) *Attorney, Agent, or Firm*—Dennis W. Beech

(57) ABSTRACT

A piston for an internal combustion engine of the spark ignition type has cavities formed in the crown in a pattern to cover approximately 16 to 18 percent of the piston head surface area. The cavities are formed in a pattern wherein no cavity edge is closer than approximately ¼ inch to ½ inch of any adjacent cavity edge or to the perimeter of the piston head. The cavities are generally cylindrical wall structures having a bottom in the form of a cone tapered to a central point. The depth of the cavity is approximately 55 percent of the cavity diameter.

14 Claims, 1 Drawing Sheet

PISTON HEAD FOR A SPARK IGNITION ENGINE

BACKGROUND OF THE INVENTION

This invention relates to piston heads for internal combustion engines of the spark ignition type. The improved piston head has cavities incorporated in the piston head to facilitate the mixture of fuel and air in the combustion chamber.

It is known in the art that good or complete combustion of fuel in an engine depends on thorough mixing of the fuel and air introduced into the combustion chamber as part of the engine combustion process. There are numerous examples of processes and apparatus that control the manner of fuel introduction into an engine. Examples include precombustion chambers, fuel injection methods and other like fuel control means.

Most of the attempts to improve the mixing of fuel and air include modification of the cylinder head or portions of the engine that involve the introduction of the fuel and air into the cylinder of the engine. These alterations may be designed to operate in conjunction with modification to the head of the piston or to the entire piston. All of these designs require extensive modifications to the engine and in particular to the cylinder head and/or piston head.

An example of a modification to a piston or piston head to facilitate fuel distribution for a compression ignition type engine is disclosed in U.S. Pat. No. 3,057,334. In this case a heat plug is mounted in the central portion of the piston. A portion of the plug extends above the head of the piston and has radial grooves formed therein. The fuel issues through a throat from a precombustion chamber to impinge on the plug. The plug grooves serve to disperse the fuel radially outward to promote mixing. This disclosure requires extensive changes to the piston structure as well as a precombustor chamber in the cylinder head.

There are other designs that only modify the piston head to improve fuel entry and exit as well as fuel mixing. U.S. Pat. No. 6,170,454B1 is an example of such a modification. In this instance the contour of the piston head has been modified to affect fuel entry and exhaust flow in the combustion chamber. The structure is designed to circulate the fuel and air mixture circumferentially about the combustion chamber. The contour also serves to con centrate the gas as for example adjacent to the exhaust port during the exhaust cycle. As an additional element to enhance the homogenizing of the fuel and air mixture, shallow dimples are formed in the top or crown of the piston head in multiple cluster configurations. As can be seen there is a need for a simple piston head structure to facilitate thorough mixing of fuel and air to promote efficient combustion. The use of shallow dimples alone will not maximize fuel and air mixing and combustion.

As can be seen, there is a need for a simple method to modify the structure of the internal combustion engine combustion chamber to promote good fuel combustion in the engine.

SUMMARY OF THE INVENTION

One object of the present invention is improved combustion of fuel in an engine. Another object is simple modification of engines to increase horsepower and improve fuel usage.

These and other features, aspects and advantages of the present invention will become better understood with reference to the following drawings, description and claims.

DESCRIPTION OF THE PREFERRED EMBODIMENT

The following detailed description is the best currently contemplated modes for carrying out the invention. The description is not to be taken in a limiting sense, but is made merely for the purpose of illustrating the general principles of the invention.

Figure 1:
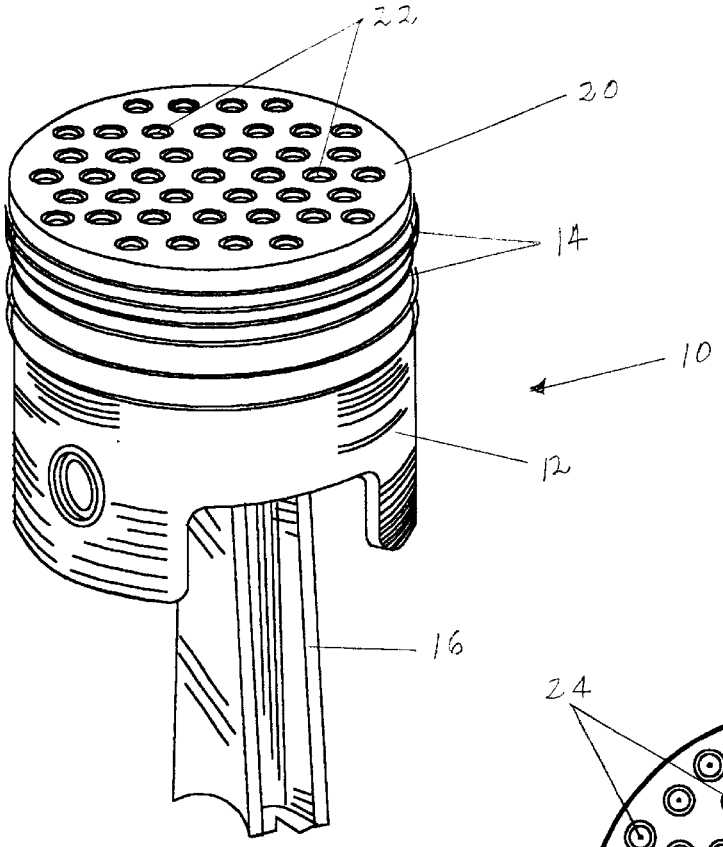
FIG. 1 illustrates a top perspective view of a piston and partial piston rod according to an embodiment of the invention.
Figure 2:
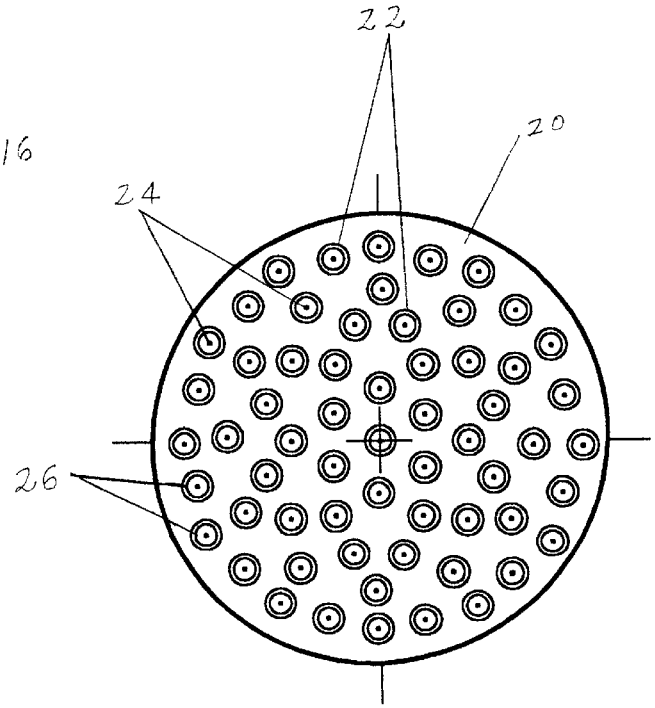
FIG. 2 illustrates a top plan view of a piston head according to the invention.
Figure 3:
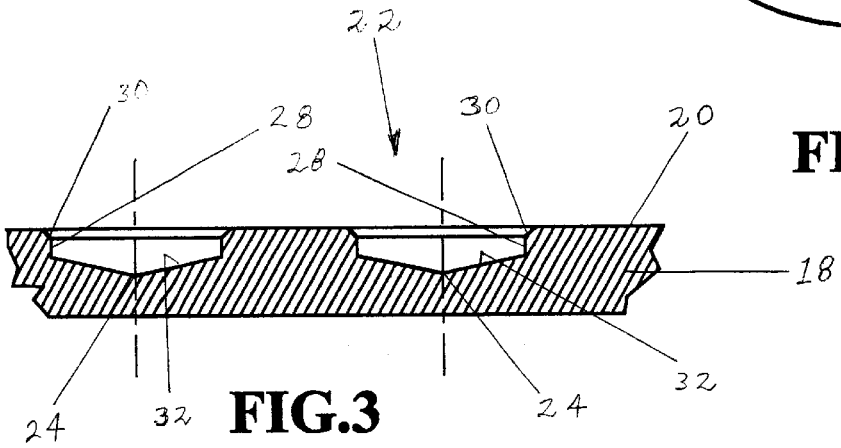
FIG. 3 illustrates a cross-sectional, side elevation view of a piston head according to the invention.

Referring to FIGS. 1 through 3, a piston 10 for an internal combustion engine has cylindrical sidewall 12, rings 14, piston rod 16 and piston head 20. The general structure of the piston 10 is as is commonly understood in the art for internal combustion engines having a cylinder block with cylinders formed therein, and a cylinder head having intake and exhaust ports as well as a spark plug for ignition. While this structure is disclosed for purposes of presenting a preferred embodiment, other engines, such as, compression ignition systems may benefit from the improved piston head.

As can best be seen in FIGS. 1 and 2 the piston head 20 has a plurality of cavities 22 formed therein. The cavities 22 may be formed in the piston head 20 by drilling or other suitable means for boring in the metal of the piston 10. Also, in the instance of casting of pistons 10 other methods for forming the cavities 22 may be used.

Experiments have shown that for an engine having a cylinder bore of 4 inches to 4⅜ inches, approximately 80 to 100 cavities provide improved fuel combustion efficiency in the engine and increased horsepower. The cavities 22 were drilled in the piston head 20 with the cavities approximately centrally disposed on a plurality of imaginary concentric circles spaced approximately ½ inch apart. A polar bolt circle program was used to control the cavity drilling machine. No two cavities 22 were permitted to be closer than ⅜ inch relative to the circumferential cavity edges 26. These parameters resulted in cavities occupying approximately 16% to 18% of the piston head 20 surface area. While this particular cavity 22 pattern was used for the experiment, other patterns may also be used so long as adjacent cavity edges 26 are no closer than approximately ⅜ inch for a 4 inch to 4⅜ inch piston 10. For piston heads 20 having valve relief voids in the surface no cavities were drilled in the edges of the voids.

The cavities 22 as described above were drilled to a depth of approximately 0.090 to 0.100 inches to the bottom 32 cavity center 24. The depths of the cavities 22 were made approximately 55% of the diameter of the cavity. A 3/16 inch drill bit was used to form the cavities 22. The pitch of the drill bit point produced a cavity 22 that had a wall 28 height of approximately 0.060 to 0.070 inches and produced a cone shaped bottom 24. The top corner or shoulder 30 of the cavities 22 was rounded or otherwise beveled to reduce sharp edges. The crown 18 thickness of the piston head 20 was approximately 0.280 to 0.375 inches.

The introduction of the cavities 22 in the piston head 20 of an existing engine decreased the compression ratio by approximately 0.50. It was found that the engine performed well with a compression ratio of 11 to 1. The normal timing for the test engine was 36 to 42 degrees. An adjustment to approximately 26 to 30 degrees was made when using the modified piston head 20. Further, with the improved piston 10 in the test engine there was less fuel use; therefore, the engine fuel intake was modified for restricted or reduced fuel consumption.

There were unexpected results based on the piston head 20 modifications discovered during the testing of the invention. The tested engine break specific fuel consumption (BSFC) exhibited a range of 0.35 to 0.38 lbs/HP/hr as compared to a standard engine operating range of 0.50 to 0.55 lbs/HP/hr with the test engine demonstrating good performance without the engine at full throttle. At full throttle the engine measurements indicated approximately a 5 to 10 percent power increase and a 25 percent to 30 percent reduction in fuel usage.

While the preferred embodiment has been described relative to a particular configuration of engine, it can be appreciated that with appropriate scaling of the cavities and cavity patterns as well as other engine adjustments may allow for increased engine fuel performance.

We claim:

1. A piston for use in an internal combustion engine comprising:

a piston having a plurality of cavities formed therein in a piston head;

each cavity having a diameter of between approximately ⅛ inch and ¼ inch and a depth to a cavity center is approximately 55 percent of the cavity diameter; and the cavities disposed in the piston head to maximize the number of cavities such that no cavity edge is closer than approximately ¼ inch to ½ inch to any adjacent cavity edge and to the perimeter of the piston head.

2. The piston as in claim 1 wherein the cavities are defined by a cylindrical wall and a bottom tapered to a point at the cavity center.

3. The piston as in claim 1 wherein a cavity edge is beveled.

4. The piston as in claim 1 wherein the piston having a circumference of approximately between 4 inches and 4⅜ inches.

5. The piston as in claim 4 wherein the piston having a crown thickness of approximately 0.280 inch to 0.375 inch.

6. The piston as in claim 1 wherein the cavities having a depth of approximately 0.090 inch to 0.100 inch to the cavity center at a bottom thereof.

7. The piston as in claim 6 wherein the cavities having an approximate vertical wall height of 0.060 inch to 0.070 inch tapering at the bottom to the cavity center thereby forming a cone.

8. A piston for use in an internal combustion engine comprising:

a piston having a circumference between approximately 4 inches and 4⅜ inches;

a piston head having approximately 80 to 100 cavities formed therein;

each cavity having a diameter of approximately 3/16 inch and a depth to a cavity center of approximately 55 percent of the cavity diameter;

the cavities disposed in the piston head such that no cavity edge is closer than approximately ⅜ inch to any adjacent cavity edge and to the perimeter of the piston head.

9. The piston as in claim 8 wherein the piston having a crown thickness of approximately 0.280 inch to 0.375 inch.

10. The piston as in claim 8 wherein the cavities are defined by a cylindrical wall and a bottom tapered to a point at the cavity center.

11. The piston as in claim 10 wherein the cylindrical wall height is approximately 0.60 inch to 0.070 inch.

12. The piston as in claim 8 wherein a cavity edge is beveled.

13. A piston for use in an internal combustion engine comprising:

a piston having a plurality of cavities formed therein in a piston head;

each cavity having a diameter of between approximately ⅛ inch and ¼ inch and a depth to a cavity center at a bottom thereof is approximately 55 percent of the cavity diameter;

each cavity is defined by a cylindrical wall and a bottom tapered to a point at the cavity center wherein the cavity having a depth of approximately 0.090 inch to 0.100 inch to the cavity center;

the cylindrical wall having a wall height of approximately 0.060 inch to 0.070 inch; and the cavities disposed in the piston head to maximize the number of cavities such that no cavity edge is closer than approximately ¼ inch to ½ inch to any adjacent cavity edge and to the perimeter of the piston head.

14. A piston for use in an internal combustion engine comprising:

a piston having a plurality of cavities formed therein in a piston head;

each cavity having a diameter of between approximately ⅛ inch and ¼ inch and a depth to a cavity center of approximately 45 percent to 65 percent of the cavity diameter; and the cavities disposed in the piston head to occupy approximately 10 percent to 25 percent of the piston head surface area.

* * * * *